United States Patent [19]

Pfleiderer et al.

[11] Patent Number: 4,636,222

[45] Date of Patent: Jan. 13, 1987

[54] ENZYMATIC UNHAIRING METHOD

[75] Inventors: Ernst Pfleiderer, Darmstadt-Arheilgen; Tilman Taeger, Griesheim; Gertrud Wick, Weiterstadt, all of Fed. Rep. of Germany

[73] Assignee: Röhm GmbH, Darmstadt, Fed. Rep. of Germany

[21] Appl. No.: 760,556

[22] Filed: Jul. 30, 1985

[30] Foreign Application Priority Data

Aug. 7, 1984 [DE] Fed. Rep. of Germany ..... 3429047

[51] Int. Cl.[4] ..... C14C 1/06

[52] U.S. Cl. ..... 8/94.16

[58] Field of Search ..... 8/94.16, 94.17, 94.18

[56] References Cited

U.S. PATENT DOCUMENTS

| | | | |
|---|---|---|---|
| 2,132,579 | 10/1938 | Rohm | 8/94.16 |
| 3,939,040 | 2/1976 | Monsheimer | 8/94.16 |
| 4,457,759 | 7/1984 | Fekete et al. | 8/94.16 |

FOREIGN PATENT DOCUMENTS

| | | |
|---|---|---|
| 1026038 | 3/1958 | Fed. Rep. of Germany . |
| 1211349 | 2/1966 | Fed. Rep. of Germany . |
| 1230169 | 12/1966 | Fed. Rep. of Germany . |
| 2917376 | 11/1980 | Fed. Rep. of Germany . |
| 3224881 | 3/1984 | Fed. Rep. of Germany . |
| 0138479 | 11/1979 | German Democratic Rep. . |

OTHER PUBLICATIONS

The Enzymes, (Boyer, Editor), 3d Edn., vol. III, Academic Press, 1971, New York, p. 733.

The Enzymes, (Boyer, Editor), 2d Edn., vol. 4, Academic Press, 1960, New York, p. 213.

Keay, Process Biochemistry, Aug. 1971, p. 17.

Uhlig, Biochemical Properties of Microbial Proteases, from *Biochemistry and the Therapeutic Use of Digestive Enzymes,* International Symposium Poertschach, Sep. 30, 1972, Stormarn-Verlag.

*Primary Examiner*—Paul Lieberman

*Assistant Examiner*—John F. McNally

[57] ABSTRACT

An enzymatic method for the unhairing of hides and skins in the alkaline pH range by treating them in a liquor at a pH from 9 to 11 with a proteolytic enzyme having an optimum activity in the pH range from 2 to 7.5, and then unhairing.

8 Claims, No Drawings

ENZYMATIC UNHAIRING METHOD

The present invention relates to an enzymatic method for the unhairing of hides and skins by the use of acid proteases.

Leather technology includes a series of steps which lead from the hide or skin right after flaying (the so-called green hide) to the pelt ready for tanning by way of beamhouse operations.

The tanner usually receives the hides and skins in a salt-cured condition, sometimes also prefleshed. The salted and dried raw stock generally is first soaked to restore it to a condition resembling that of the green hide. The treatment further involves the removal of the hair, of the epidermis and of the connective tissue, and the loosening of the hide structure for the uptake and binding of the tanning materials.

How unhairing is performed depends on whether the hair is to be destroyed or recovered. Unhairing is usually done by liming or by painting. The destruction of the hair generally occurs through hydrolytic decomposition of the keratin. For unhairing under hair-preserving conditions, the junction between epidermis and corium must be loosened.

In practice, liming is done either in a hydroxyl bath, in which sodium or potassium hydroxide, ammonia, and particularly calcium hydroxide are used, or a in a sulfide liquor, the action of which is based primarily on cleavage of the disulfide links of the keratin molecules. This action is aided by calcium hydroxide, for example, which loosens the collagen structure through swelling and releases interfibrillar noncollagenous proteins. In enzymatic unhairing, hair loosening and liming are separate operations.

Enzymatic unhairing methods have long been known (cf. German patent publications Nos. 1 026 038 and 1 211 349). German patent publication No. 1 230 169 proposes a method for the preparation of pelts ready for tanning by enzymatic unhairing of the hides and skins with proteolytic enzymes with the addition of carbohydrases at pH 5.5 to 10 and an aftertreatment of the dehaired hides and skins with proteolytic enzymes from microorganisms at pH 3.0 to 5.5.

German patent publication No. 29 17 376 teaches an enzymatic method for recovery of hair and simultaneous opening of the hide structure wherein a hide from which the curing salt has been removed is first treated in the acid pH range with substances which cleave the disulfide links. Loosening of the hair and opening of the hide structure are then carried out concurrently, without prior soaking, at a pH of about 11 to 13 by the use of proteases active in the alkaline range.

After liming, the condition of the hide is such that any still adhering noncollagenous constituents can readily be removed. The steps which follow are the usual beamhouse operations, for example deliming and bating, and optionally pickling. (See Ullmanns Enzyklopädie der technischen Chemie, 4th ed., vol. 16, pp. 111–174, Verlag Chemie).

The method described in German patent publication No. 32 24 881 represents a new approach. After flaying, any adhering dirt is removed from the hide stock, which is fleshed either then or later, then soaked, freed of hair and scud in a short-time unhairing operation, and finally, in a deswelled and neutral condition, preserved with common salt.

As is known, proteases can be classed either on the basis of their origin or according to the pH dependence of their action on specific substrates. The range over which proteases are stable and active extends from pH 2 to 12 and higher. By and large, the pH ranges of optimum activity coincide with those of optimum stability. In addition to specificity, further criteria of selection for use are thermal stability and the effect of inhibitors on the individual proteases.

"Alkaline proteases" generally are proteolytic enzymes whose range of activity toward casein or hemoglobin (on the basis of standardized methods) extends from pH 7 to 12 and higher. By the same token, "neutral proteases" are those whose range of activity extends from pH 6 to 9 and "acid proteases" are proteolytic enzymes whose range of activity extends below pH 7.5, and usually from pH 2 to 7.

One of the main problems encountered in connection with unhairing is insufficient loosening of the hair, as a result of which short hair (underhair) is left standing in places during the unhairing operation. While such short hair usually is less troublesome in the case of bottom leather, it is often the cause of serious defects on upper leather, such as a rough surface, nonuniform dyeing, unevenness when top layers are applied, and so forth.

In addition to the underhair problem, enzymatic unhairing has in the past posed the problem, especially in the case of cattlehides, of the hide substance being severely attacked, particularly at the interface of the papillary and reticular layers. Because of this, it has not been possible up to now to manufacture firm-grained shoe uppers, for example, having a thickness of the leather greater than 1.2 mm.

Thus there has been a need for an enzymatic unhairing method that will remove the short hair or underhair as completely as possible but is not subject to the aforementioned drawbacks, for example to a pronounced degradation of the grain due to the decomposition of hide substance.

It has been found that this need is ideally met by the present invention, which is an enzymatic method for the unhairing of hides and skins in which the soaked hides and skins are treated in a bath which is at a pH ranging from 9 to 11 with proteolytic enzymes which optimally act on the test substrates casein and hemoglobin (cf. Ullmanns Enzyklopädie der technischen Chemie, 4th ed., vol. 10) in the acid range, and more particularly in the pH range from 2 to 7.5.

Thus, the enzymes used are acid proteases, as usually defined, whose range of optimal acitivity, and generally also of stability, falls into the acid pH range, and more particularly into the pH range from 2 to 7, and preferably to 6.5. More particularly, they are proteases with optimum activity in the acid range whose activity toward said substrates at pH 10 is not more than 20 percent of their optimum activity.

As is known, acid proteinases can be obtained from higher animals and plants as well as from microorganisms.

Especially fungal acid proteinases, for example the acid proteinases from Aspergillus species (*A. oryzae, A. saitoi, A. parasiticus, A. usamii,* and *A. awamori*), from a *Paecilomyces* species (*Paecilomyces varioti*), from *Penicillium* species (*P. roqueforti* and others), from an *Acrocylindrium* species, from *Trametes sanguinee*, from a *Rhizopus* species (*R. chinensis*), and from Mucor *pusilius*, are suitable. Acid proteases of animal origin, such as pancreatin, and plant proteases such as papain, bromelin, and ficin are also usable. Enzyme combinations may also be used.

The amount of enzyme to be used depends on the activity of the enzyme. As a rule, from 0.5 to 6.0 weight percent, and preferably from 2.0 to 3.0 weight percent, based on the weight of the salted hides or skins, should be used. The enzyme activity generally should range from 50 to 200 $mU_{Hb}$/gram, and preferably from 80 to 100 $mU_{hb}$/gram, as defined below.

The proteolytic activity of enzymes is usually determined by the Anson hemoglobin method (M. L. Anson, J. Gen. Physiol. 22, 79 [1939]) or by the Löhlein-Volhard method, "Löhlein-Volhardsche Methode zur Bestimmung der proteolytischen Aktivität", Gerbereichemisches Taschenbuch, Dresden-Leipzig, 1955) and expressed in Löhlein-Volhard units (LVU). One LVU is the amount of enzyme which under the specific conditions of the method will digest 1.725 mg of casein.

In the examples which follow, units derived from the Anson method are also used for the determination of the activity of enzymes active in the acid pH range. These are termed "proteinase units (hemoglobin)" ($U_{Hb}$). One $U_{Hb}$ is the amount of enzyme which will catalyze the liberation of fragments soluble in trichloroacetic acid from hemoglobin at a rate equivalent to 1 micromole of tyrosine per minute at 37° C. (measured at 280 nm). 1 $mU_{Hb}=10^{-3}U_{Hb}$.

The method of the invention can be used to unhair, dewool, or debristle animal hides and skins generally. To carry out the method, the cured skins are first thoroughly soaked. Thorough soaking is an absolute necessity if the method of the invention is to be fully effective. Dried hides and skins are soaked overnight while salted hides and skins are advantageously soaked enzymatically for from 4 to 6 hours. The soak liquor is usually discarded after the soak.

The unhairing method of the invention is advantageously carried out with fresh liquor. Unhairing will be facilitated if the soak is followed by machine fleshing. To open the hide structure and to remove any remaining hair, the stock is then subjected conventionally to reductive and alkaline liming, preferably with recirculation.

In accordance with the invention, unhairing, dewooling, or debristling are performed in fresh liquor which contains from 50 to 300 percent of water, based on the soak weight of the stock, depending on the type of the pelt. The treating time of the hides and skins with the proteolytic enzymes in the enzymatic liquor ranges from 12 to 36 hours, and preferably from 16 to 18 hours. The temperature of the liquor is advantageously between 25° C. and 27° C.

For unhairing, the enzyme product is added to the pelts in the bath in powder form, for example. As a rule, the amount of enzyme needed in the method of the invention will range from 2 to 10 $mU_{Hb}$ per gram of salted or dried stock.

For the unhairing of goatskins, enzymes having an activity of from 4.0 to 6.0 $mU_{Hb}$ per gram of dry weight are required. For the unhairing of hides, from 2.0 to 3.0 $mU_{Hb}$; for removal of the bristles from pigskins, from 4.0 to 6.0 $mU_{Hb}$; and for the dewooling of sheepskins, from 6.0 to 8.0 $mU_{Hb}$ per gram of salted weight are advantageously used.

The pH value of the liquor is adjusted with alkali, and advantageously with calcined soda, to a value in the range from pH 9 to 11, and preferably to pH 10±0.5. At the start the bath is agitated for a period ranging from 30 minutes to 2 hours and thereafter only intermittently from 5 to 10 minutes every hour. The method can be carried out in a drum, tanning machine, mixer or paddle vat. The hair or the bristles are loosened during the treating time. Sheepskins are then dewooled by hand or by machine. The bristles of pigskins are usually removed by machine, and the loosened hair of calfskins and cattle hides can be recovered by tumbling or machine unhairing. Simultaneous machine fleshing and unhairing is also possible, for example on a Stehling machine.

The percentages in the following examples, given by way of illustration, are weight percentages.

EXAMPLE 1

Enzymatic unhairing of bullhides

Raw stock: Bullhides, black and white, weight class 30 to 39.5 kg

Salted weight: 2000 kg

Cleansing soak (drum): 150% water, inlet temperature 27° C. Rotate at 4 rpm. Treating time, 2 hours. Drain liquor.

Main soak (drum):

- 150% water, inlet temperature 27° C.,
- 1% enzymatic soaking agent, (*Bacillus subtilis*) with 1500 LVU/g. Treating time, 4 hours, during which agitate at 4 rpm. Drain liquor.

Fleshing:

Hair loosening (drum):

- 100% water, 27° C.,
- 3% enzymatic depilatory comprising *Aspergillus parasiticus* with 80 $mU_{Hb}$/g, Add
- 1% calcined soda, agitate for 1 hour. Treating time, 18 hrs., during which agitate for 2 minutes every hour.

The pH value of the liquor is 10. The hides are removed from the drum and unhaired. Following unhairing, the opening of the hide structure is carried out for 5 hours as a drum unhairing. The hides can be completely unhaired and exhibit little degradation. The scud has been largely removed from the pigmented areas. The percentages are based on the salted weight of the pelts.

EXAMPLE 2

Enzymatic unhairing of dried goatskins

Raw stock: Dried Chinese goatskins

Dry weight: 1000 kg

Soak (drum):

- 500% water, inlet temperature 25° C.,
- 1.2% enzymatic soaking agent derived from *B. licheniformis* with 4000 LVU/g.
- 1.8% sodium hydroxide solution, 33%. Treating time, 14 hours. Agitate for 5 minutes every hour. Next morning, tumble for 3 hours at 4 rpm, then drain liquor.

Hair loosening (drum):

- 500% water, inlet temperature 25° C.,
- 6% depilatory of *Aspergillus oryzae* with 100 $mU_{Hb}$/g,
- 6% calcined soda. At first agitate for 2 hours at 4 rpm. Treating time, 24 hours, during which agitate for 5 minutes every 3 hours.

pH value of hair-loosening liquor: 10.

Unhairing: All pelts can readily be unhaired to an extent of 95 to 100%.

Fleshing: After fleshing, opening of the hide structure is carried out for 24 hours. After unhairing, the pelts are free of hair and scud. They exhibit no degradation indicative of excessive decomposition of hide substance and have a flat, elastic grain.

EXAMPLE 3

Enzymatic dewooling of short-wooled New Zealand sheepskins

Raw stock: Short-wooled New Zealand sheepskins, salted

Salted weight: 3000 kg=1000 skins

Soak:

- 500% water, inlet temperature 30° C.,
- 2% enzymatic soaking agent of *Bacillus mesentericus* with 1500 LVU/g,
- 1% calcined soda. Treating time, 7 hours. Alternatively agitate for 20 minutes and let stand for 20 minutes.

Fleshing

Enzymatic loosening of wool:

Liming mixture: Dissolve in 1 liter water:

- 300 g dewooling agent of *Paecilomyces varioti* with 120 $mU_{Hb}/g$,
- 150 g magnesium carbonate,
- 5 g sodium bicarbonate,
- 3 g chloroacetamide.

600 g of this mixture are uniformly distributed on the flesh side of a skin. The skins are then placed on wooden slabs 20 to a slab and left there overnight.

Dewooling: Can be done by machine or manually, by pulling. The skins can be readily dewooled so that one man can dewool two skins in one minute. From 95 to 98% of the wool on the skin can be recovered. The dewooled skins are white in color and have no putrefactive areas. After dewooling, they are kept for 4 to 6 hours in a lime liquor with alkalis and reducing agents to open the skin structure.

The percentages are based on the salted weight of the skins.

EXAMPLE 4

Enzymatic debristling of pigskins

Raw stock: Polish pigskins, salted, weight 5 kg each.

Salted weight: 2000 kg

Washing (mixer):

- 120% water, inlet temperature 27° C.,
- 0.2% nonionic surfactant comprising ethoxylated nonylphenol. Agitate for 60 minutes, then drain liquor.

Soak (mixer):

- 120% water, inlet temperature 27° C.,
- 0.5% enzymatic soaking agent of *Bacillus licheniformis* with 4000 LVU/g,
- 1.0% sodium hydroxide solution, 33%,
- 0.5% nonionic surfactant as above. Agitate for 60 minutes. Treating time, 18 hours.

During the day, agitate for 5 minutes every hour; at night, let stand. The next morning, tumble for 30 minutes.

Degreasing and fleshing

Enzymatic loosening of bristles (mixer):

- 120% water, 27° C.,
- 4% enzyme product derived from *Aspergillus usamii* with 100 $mU_{Hb}/g$,
- 2% calcined soda. Agitate for 60 minutes. Treating time, 18 hours. Agitate for 5 minutes every third hour.

Removal of bristles: The pigskins can be readily debristled. 200 kg of wet bristles are obtained. After debristling, the skins are free of bristles to an extent of 90 to 95%. They are light in color and exhibit no grain damage. To open the skin structure, they are then immersed in an afterliming liquor comprising alkalis and reducing agents.

The percentages are based on the salted weight of the skins.

What is claimed is:

1. An enzymatic method for the unhairing of hides and skins in the alkaline pH range, which comprises treating soaked hides and skins for a period of 12 to 36 hours at a pH range from 9 to 11, with a proteolytic enzyme having an optimum activity in the pH range of from 2 to 7.5 and then unhairing, said enzyme being used at a proportion from 2 to 10 m $U_{H6}$ per gram of salted or dried hides and skins said enzyme being the sole active unhairing agent.

2. A method as in claim 1 wherein said proteolytic enzyme is an acid protease having optimum activity in the pH range from 2 to 7.

3. A method as in claim 1 wherein said proteolytic enzyme is a fungal acid protease.

4. A method as in claim 3 wherein said fungal acid protease is from a Rhizopus species.

5. A method as in claim 1 wherein said proteolytic enzyme is an acid protease from an Aspergillus species.

6. A method as in claim 1 wherein said proteolytic enzyme is an acid protease from a Penicillium species.

7. A method as in claim 1 wherein said proteolytic enzyme has a proteolytic activity from 50 to 200 $mU_b$/-gram.

8. A method as in claim 1 wherein said liquor represents from 100 to 300 weight percent of the soak weight of the hides and skins.

* * * * *